US012122626B2

(12) United States Patent
Kazama

(10) Patent No.: US 12,122,626 B2
(45) Date of Patent: Oct. 22, 2024

(54) SHEET STACKER AND IMAGE FORMING APPARATUS

(71) Applicant: Ikumi Kazama, Kanagawa (JP)

(72) Inventor: Ikumi Kazama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 17 days.

(21) Appl. No.: 18/171,922

(22) Filed: Feb. 21, 2023

(65) Prior Publication Data

US 2023/0286769 A1 Sep. 14, 2023

(30) Foreign Application Priority Data

Mar. 9, 2022 (JP) ..... 2022-036327

(51) Int. Cl.
*B65H 31/10* (2006.01)
*B65H 43/00* (2006.01)

(52) U.S. Cl.
CPC ..... *B65H 31/10* (2013.01); *B65H 43/00* (2013.01)

(58) Field of Classification Search
CPC ..... B65H 43/00; B65H 2553/416; B65H 31/10; B65H 2553/412; B65H 255/416
See application file for complete search history.

(56) References Cited

U.S. PATENT DOCUMENTS 5,629,672 A * 5/1997 Brown ..... B65H 7/04 340/568.1
2009/0179375 A1* 7/2009 Tamura ..... B65H 31/20 271/221
2016/0060070 A1* 3/2016 Hodatsu ..... G07D 11/10 271/265.04
2020/0299090 A1* 9/2020 Uchida ..... B65H 1/14
2021/0395033 A1 12/2021 Kazama
2022/0177255 A1 6/2022 Kazama
2023/0294951 A1* 9/2023 Mac ..... B65H 29/52 270/52.01

FOREIGN PATENT DOCUMENTS

EP 2243736 A2 * 10/2010 ..... B65H 29/041
JP 6-006334 1/1994
JP 2010-253762 11/2010
JP 2020-152506 9/2020

* cited by examiner

*Primary Examiner* — Jennifer Bahls
(74) *Attorney, Agent, or Firm* — IPUSA, PLLC

(57) ABSTRACT

A sheet stacker includes a lifting mechanism, a tray, a conveyor, processing circuitry, an upper-limit sensor, a lift pause sensor, a lower-limit sensor, and a lowering pause sensor. The tray stacks multiple sheets. The conveyor above the tray conveys a sheet. The processing circuitry controls, via the lifting mechanism, a height position of the tray. The upper-limit sensor detects that an uppermost sheet of the sheets has reached an upper-limit position. The lift pause sensor detects that the uppermost sheet has reached a lift pause position lower than the upper-limit position. The lower-limit sensor detects that the tray has reached a lower-limit position. The lowering pause sensor detects that the tray has reached a lowering pause position higher than the lower-limit position. The upper-limit sensor, the lift pause sensor, the lower-limit sensor, and the lowering pause sensor are disposed in a space in which the tray is lifted and lowered.

8 Claims, 9 Drawing Sheets

SHEET STACKER AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2022-036327, filed on Mar. 9, 2022, in the Japan Patent Office, the entire disclosure of which is hereby incorporated by reference herein.

BACKGROUND

Technical Field

Embodiments of the present disclosure relate to a sheet stacker and an image forming apparatus.

Related Art

A sheet stacker is known that includes a conveyor to convey a sheet and a tray including a stacking table as a sheet pallet on which conveyed sheets are stacked. The sheet stacker employs a stacking method in which the sheet pallet is continuously lowered as the amount of sheets stacked on the sheet pallet increases to allow a relatively large amount of sheets to be stacked at a time. Further, an image forming apparatus is known that includes an image forming device to form an image on a sheet conveyed by a conveyor and a sheet stacking device to stack sheets on which the image has been formed by the image forming device.

Preferably, the sheet stacker is controlled such that, when a sheet on which an image has been formed is ejected onto the sheet pallet during printing, the sheet stacker lifts the sheet pallet to receive the sheet at an upper position of the sheet pallet and lowers the sheet pallet as the sheet is ejected so that an uppermost sheet of sheets stacked on the sheet pallet does not reach an upper limit of the height of the sheet pallet. A method is known in which the sheet pallet is automatically lifted or lowered after the operator operates a button and a method is known in which the sheet pallet is lifted or lowered only while the operator is pressing the button.

The sheet stacker is installed downstream from the image forming device in a sheet conveyance direction. When the sheet stacker is controlled such that the sheet pallet is automatically lifted or lowered, the sheet pallet may collide with a component such as a sheet ejection device that ejects a sheet from the image forming device. Accordingly, a part of the image forming apparatus or a part of the sheet stacker may be damaged.

For the purpose of preventing the breakage of the components as described above, a device is known that prevents the sheet stacker from being pushed up. Such a device includes a lift-limit sensor and detects that a sheet pallet has been lifted to a position just below the lift-limit sensor and reduces the lifting speed of the sheet stacker.

SUMMARY

In an embodiment of the present disclosure, a sheet stacker includes a lifting mechanism, a tray, a conveyor, processing circuitry, an upper-limit sensor, a lift pause sensor, a lower-limit sensor, and a lowering pause sensor. The tray stacks multiple sheets. The conveyor above the tray conveys a sheet in a conveyance direction. The processing circuitry controls, via the lifting mechanism, a height position of the tray on which the multiple sheets conveyed by the conveyor is stacked. The upper-limit sensor detects that an uppermost sheet of the multiple sheets stacked on the tray has reached an upper-limit position. The lift pause sensor detects that the uppermost sheet of the multiple sheets stacked on the tray has reached a lift pause position lower than the upper-limit position. The lower-limit sensor detects that the tray has reached a lower-limit position. The lowering pause sensor detects that the tray has reached a lowering pause position higher than the lower-limit position. The upper-limit sensor, the lift pause sensor, the lower-limit sensor, and the lowering pause sensor are disposed in a space in which the tray is lifted and lowered.

In another embodiment of the present disclosure, an image forming apparatus includes an image former and the sheet stacker. The image former forms an image on a sheet. The sheet stacker stacks the sheet on which the image has been formed by the image former on the tray.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
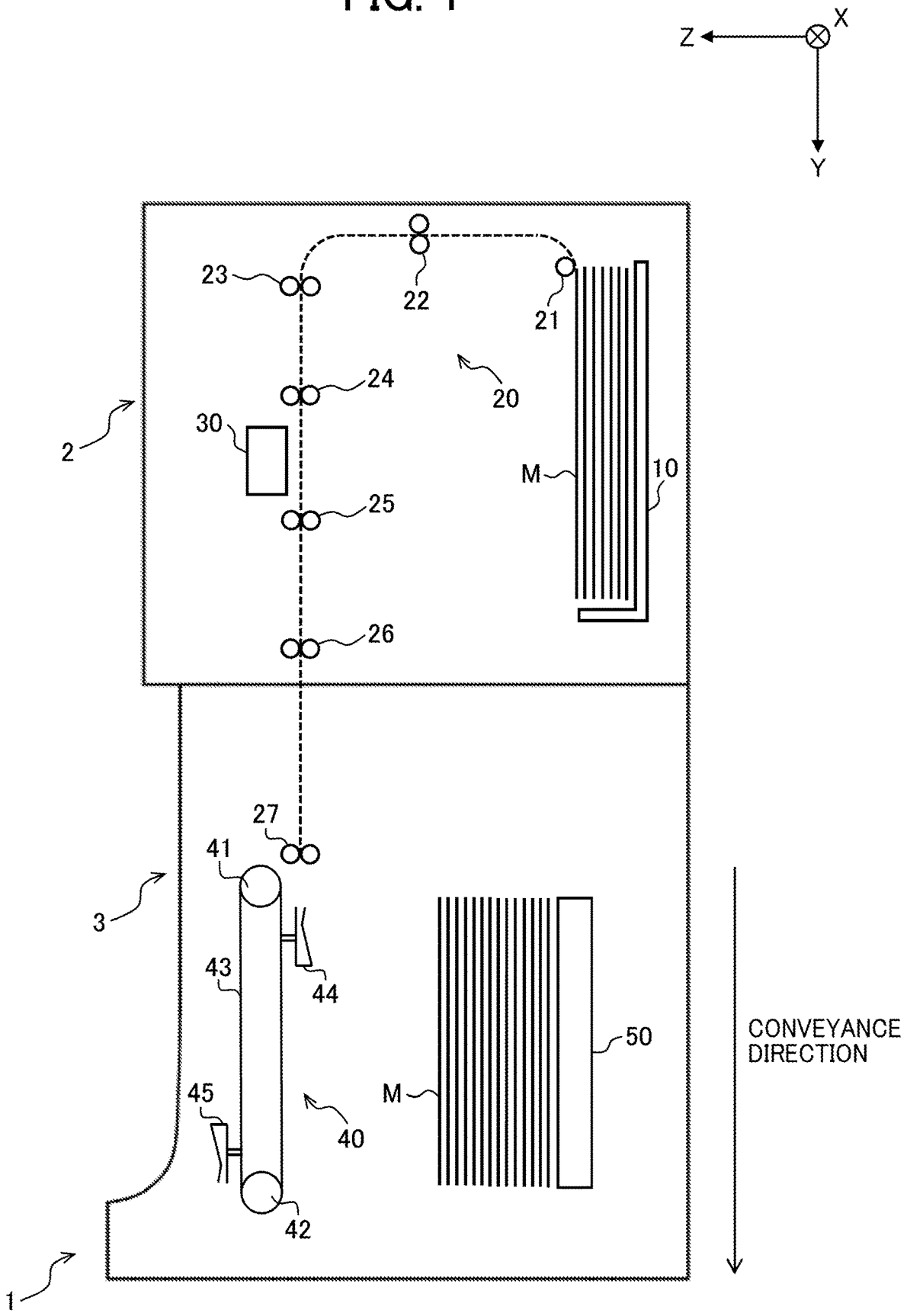
FIG. 1 is a diagram illustrating an overall configuration and an internal structure of a printer as an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity.

However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Embodiments according to the present disclosure are described with reference to the drawings in the following description. FIG. 1 is a diagram illustrating an overall configuration and an internal structure of a printer 1 as an image forming apparatus, according to the present embodiment.

Overall Configuration of Printer 1

As illustrated in FIG. 1, the printer 1 is an apparatus that forms an image on a sheet M as a sheet-shaped medium and ejects the sheet M. The printer 1 includes an image forming device 2 and a sheet stacker 3. The sheet stacker 3 serves as a sheet stacking device according to embodiments of the present disclosure. Details of the sheet stacker 3 will be described below.

Note that in the description of embodiments of the present disclosure, a sheet M is a sheet-shaped medium as a medium to be conveyed and stacked. Various types of sheets can be employed as a sheet M. For example, paper (sheet of paper), an overhead projector (OHP) sheet, thread, fiber, cloth, leather, metal, and plastic can be employed as a sheet M. However, embodiments of the present disclosure are not limited to the above-described examples. The sheet M is a sheet-shaped medium on which an image can be formed. The sheet M may be any media, not limited to those listed above, as long as the media is conveyable and stackable. In the following description, the sheet M is a sheet of paper.

Configuration of Image Forming Device 2

The image forming device 2 illustrated in FIG. 1 typically includes a sheet tray 10, a conveyor 20, and an image former 30. The sheet stacker 3 typically includes a leading-end guide 40 and an output tray 50 as a sheet tray.

The sheet tray 10 stores sheets M in a stacked state on which no images are formed yet. The conveyor 20 ejects a sheet M stored in the sheet tray 10 to the output tray 50 via a position facing the image former 30. The conveyor 20 includes a sheet feeding roller 21 and multiple roller pairs 22, 23, 24, 25, 26, and 27.

The sheet feeding roller 21 rotates in contact with an uppermost sheet M stacked on the sheet tray 10. The sheet M is supplied to a conveyance path in accordance with rotation of the sheet feeding roller 21. The plurality of roller pairs 22, 23, 24, 25, 26, and 27 are arranged in the conveyance path. Note that the conveyance path is indicated by a broken line in FIG. 1. The multiple roller pairs 22, 23, 24, 25, 26, and 27 are arranged at predetermined intervals. The roller pairs 22, 23, 24, 25, 26, and 27 nip the sheet M and rotate to convey the sheet M. The conveyance path illustrated in FIG. 1 is formed in a space that extends from the sheet tray 10 to the output tray 50 via the position facing the image former 30.

Directions in which the sheet M is conveyed by the roller pairs 22, 23, 24, 25, 26, and 27 are different from each other. A conveyance direction of the sheet M conveyed by the roller pair 27 closest to the output tray 50 among the roller pairs 22, 23, 24, 25, 26, and 27 is a direction from the roller pair 26 toward the roller pair 27 on a ground surface, which is a horizontal surface, on which the printer 1 is installed. In embodiments of the present disclosure, the conveyance direction, when simply referred to as conveyance direction, indicates the conveyance direction by the roller pair 27.

The image former 30 according to embodiments of the present disclosure employs an inkjet method in which ink is discharged onto a sheet M to form an image on the sheet M. The image former 30 includes multiple head modules that discharge respective ink of cyan, magenta, yellow, and black. Each of the head modules discharges ink at a predetermined timing to form an image on the sheet M that faces the image former 30. However, in some embodiments, the image former 30 may employ an electrophotographic system that fixes toner to the sheet M to form an image.

Sheet Stacker 3

The sheet stacker 3, which is a component of the printer 1 illustrated in FIG. 1, includes the roller pair 27 as a conveyor, the leading-end guide 40, and the output tray 50. The sheet stacker 3 is an example of a sheet stacking device that stacks multiple sheets M.

The leading-end guide 40 is disposed downstream from the roller pair 27 in the conveyance direction. In addition, the roller pair 27 and the leading-end guide 40 are disposed above the output tray 50. The leading-end guide 40 guides the leading end of a sheet M, which is conveyed by the roller pair 27, downstream in the conveyance direction. Accordingly, the leading end of the sheet M that freely falls toward the output tray 50 can be prevented from floating up.

Example of Operation of Sheet Stacker 3

Figure 2:
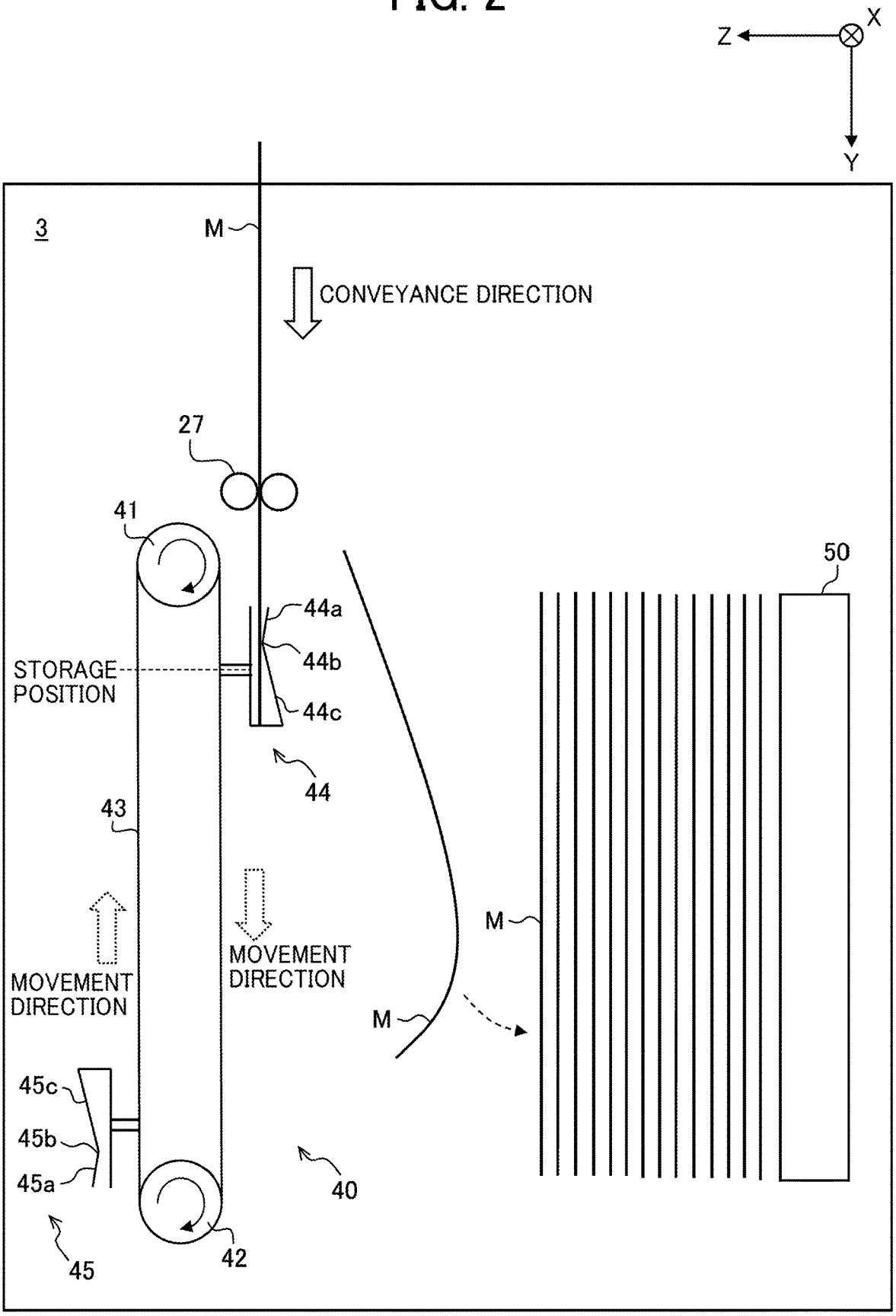
FIG. 2 is a diagram illustrating a sheet stacker when a first guide is positioned at a position at which a sheet conveyed from an image forming device is stored, according to an embodiment of the present disclosure.
Figure 3:
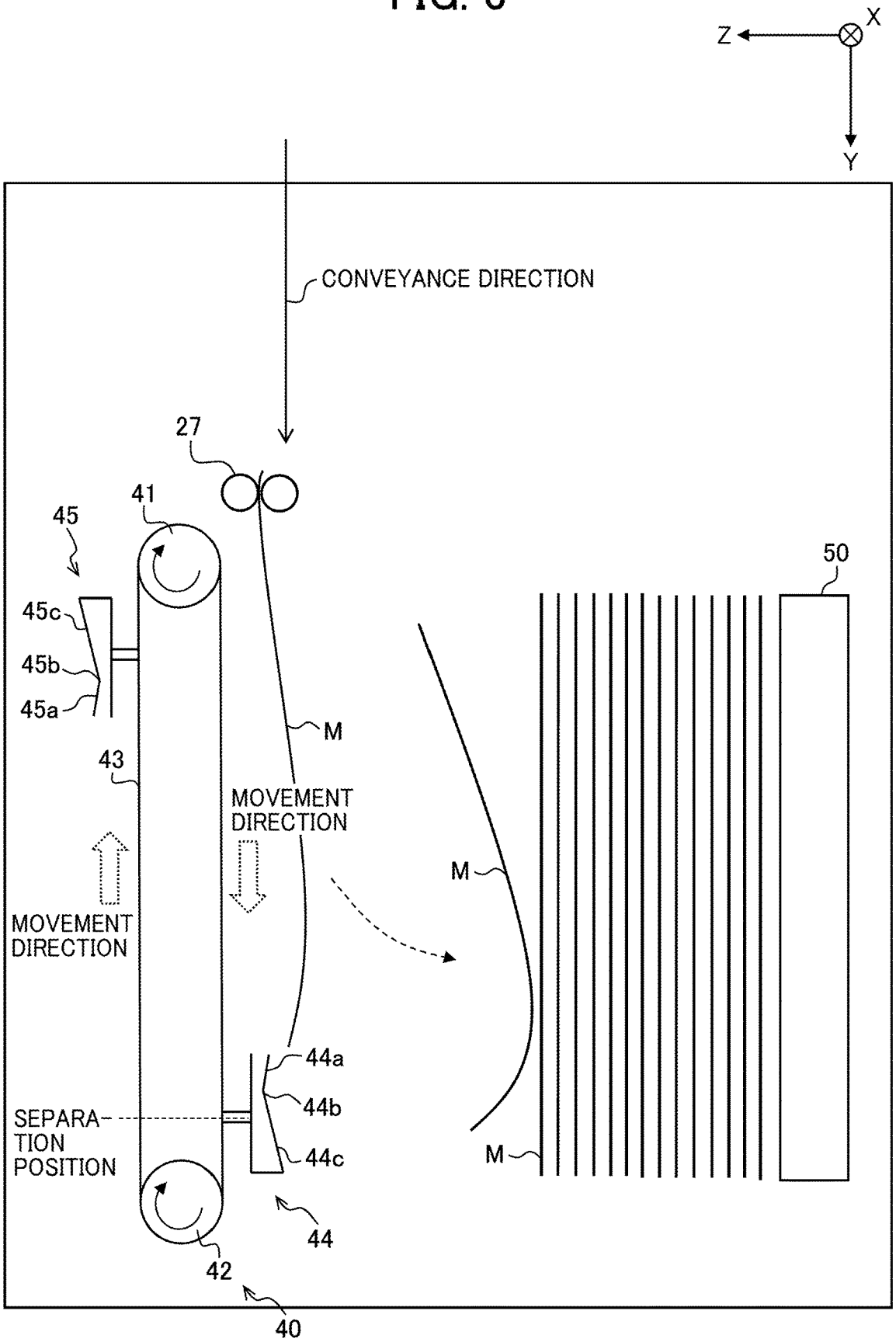
FIG. 3 is a diagram illustrating the sheet stacker of FIG. 2 when the first guide of FIG. 2 is positioned at a position at which the first guide separates a sheet.

FIG. 2 is a diagram illustrating the sheet stacker 3 when a first guide 44 is positioned at a position, which is referred to as a storage position in the following description, at which a sheet M conveyed from the image forming device 2 is stored, according to the present embodiment. FIG. 3 is a diagram illustrating the sheet stacker 3 when the first guide 44 is positioned at a position, which is referred to as a separation position in the following description, at which the first guide 44 separates a sheet M, according to the present embodiment. As illustrated in FIGS. 2 and 3, the leading-end guide 40 includes a guide driving roller 41, a guide driven roller 42, an endless annular belt 43, the first guide 44, and a second guide 45.

The guide driving roller 41 and the guide driven roller 42 are rotatably supported by the housing of the sheet stacker 3 at positions at which the guide driving roller 41 and the guide driven roller 42 are separated from each other in the conveyance direction. The endless annular belt 43 is wound around the guide driving roller 41 and the guide driven roller 42. When the driving force of a motor is transmitted to rotate the guide driving roller 41, the endless annular belt 43 rotates between the guide driving roller 41 and the guide driven roller 42. The endless annular belt 43 rotates clockwise as illustrated in FIGS. 2 and 3. In other words, the endless annular belt 43 rotates in a direction in which the lower surface of the endless annular belt 43 moves in the conveyance direction and the upper surface of the endless annular belt 43 moves in a direction opposite to the conveyance direction.

The first guide 44 and the second guide 45 are attached to an outer circumferential surface of the endless annular belt 43 at equal intervals. Accordingly, the first guide 44 and the second guide 45 move in the conveyance direction on the lower side of the endless annular belt 43 and move in the direction opposite to the conveyance direction on the upper side of the endless annular belt 43 in accordance with the rotation of the endless annular belt 43. Note that the number of the first guide 44 and the second guide 45 in total is not limited to two.

The first guide 44 includes an internal space that stores a part of the leading end of the sheet M, which is a downstream end of the sheet M in the conveyance direction. More specifically, the first guide 44 includes a first opening portion 44*a*, a first intermediate portion 44*b*, and a first rear portion 44*c*. In similar to the first guide 44, the second guide 45 includes a second opening portion 45*a*, a second intermediate portion 45*b*, and a second rear portion 45*c*. The structure of the first guide 44 is described below.

When the first guide 44 is positioned on the lower side of the endless annular belt 43, the first opening portion 44*a* opens toward upstream in the conveyance direction, in other words, toward the roller pair 27. When the first guide 44 is positioned on the lower side of the endless annular belt 43, the first intermediate portion 44*b* is positioned downstream from the first opening portion 44*a* in the conveyance direction. In addition, the first intermediate portion 44*b* includes a clearance that is smaller than a clearance of each of the first opening portion 44*a* and the first rear portion 44*c* in the up-and-down direction. When the first guide 44 is positioned on the lower side of the endless annular belt 43, the first rear portion 44*c* is positioned downstream from the first intermediate portion 44*b* in the conveyance direction. The first rear portion 44*c* contacts the leading end of a sheet M that has entered the internal space of the first guide 44 through the first opening portion 44*a*.

The clearance of each of the first opening portion 44*a*, the first intermediate portion 44*b*, and the first rear portion 44*c* in the up-and-down direction is set to be larger than the thickness of the sheet M that can be conveyed by the roller pair 27. In other words, the first guide 44 does not nip a sheet M between an upper wall and a lower wall of the first guide 44. However, the first guide 44 supports the sheet M to such an extent that the sheet M is not prevented from moving forward and backward. Accordingly, the sheet M that moves forward and backward with respect to the first guide 44 can be prevented from being damaged. However, the clearance of the first intermediate portion 44*b* in the up-and-down direction is not limited to be smaller than the clearance of each of the first opening portion 44*a* and the first rear portion 44*c* in the up-and-down direction. The clearance of each of the first opening portion 44*a*, the first intermediate portion 44*b*, and the first rear portion 44*c* in the up-and-down direction may have the same size. Alternatively, the clearance of the first rear portion 44*c* in the up-and-down direction may be smaller than the clearance of the first intermediate portion 44*b* in the up-and-down direction.

When the first guide 44 is positioned on the lower side of the endless annular belt 43, an upper face of the lower wall of the first opening portion 44*a* is inclined upward toward the first intermediate portion 44*b*. In addition, a face of the first opening portion 44*a* that can contact the sheet M is a smooth face on which, for example, no protrusion is formed. Accordingly, resistance of the sheet M entering the internal space of the first guide 44 can be reduced. Furthermore, when a portion of the first guide 44 that can contact the sheet M is made of a component having high smoothness, such as metal or resin, the sheet M can enter the internal space of the first guide 44 more smoothly.

The first guide 44 is stopped at the storage position illustrated in FIG. 2. The storage position is a position at which the first opening portion 44*a* faces the roller pair 27 on the lower side of the endless annular belt 43. In other words, the storage position is a position at which the leading end of a sheet M that has passed through the roller pair 27 can be stored. In other words, the leading end of the sheet M that is conveyed by the roller pair 27 enters the internal space of the first guide 44 through the first opening portion 44*a* and reaches the first rear portion 44*c*.

The endless annular belt 43 starts rotating when the leading end of the sheet M enters the internal space of the first guide 44, and stops again when the second guide 45 has reached the storage position. At this time, the maximum speed of the first guide 44 that moves downstream in the conveyance direction is set to be higher than the conveyance speed of the sheet M by the roller pair 27. Accordingly, the leading end of the sheet M that is stored in the first guide 44 is separated from the first guide 44 at the separation position illustrated in FIG. 3 by a speed difference between the conveyance speed of the sheet M by the roller pair 27 and the movement speed of the second guide 45.

The separation position is a position on the lower side of the endless annular belt 43 and downstream from the storage position in the conveyance direction. When the leading end of the sheet M is separated from the first guide 44, a trailing end of the sheet M, which is an upstream end of the sheet M in the conveyance direction, is still nipped by the roller pair 27. In other words, the leading-end guide 40 separates the leading end of the sheet M before the trailing end of the sheet M passes through the roller pair 27. In other words, the trailing end of the sheet M passes through the roller pair 27 after the leading end of the sheet M is separated from the leading-end guide 40.

Accordingly, the sheet M freely falls toward the output tray 50. More specifically, the leading end of the sheet M starts freely falling at the separation position. Subsequently, the trailing end of the sheet M that has passed through the roller pair 27 starts freely falling. In other words, the leading-end guide 40 stores the leading end of the sheet M conveyed by the roller pair 27 in the first guide 44 and the second guide 45 at the storage position and separates the leading end of the sheet M from the first guide 44 and the second guide 45 at the separation position to guide the sheet M to the output tray 50. The endless annular belt 43 is intermittently rotated. Thus, multiple sheets M can be ejected to the output tray 50.

The endless annular belt 43 may start rotating at a timing at which the leading end of the sheet M contacts the first rear portion 44*c* of the first guide 44 or may start rotating at a timing immediately before the leading end of the sheet M contacts the first rear portion 44*c* of the first guide 44. The sheet M is not brought into contact with the first rear portion 44*c*. Accordingly, the leading end of the sheet M can be prevented from being folded. The position of the leading end of the sheet M conveyed by the roller pair 27 can be specified by a known position sensor, such as an optical sensor, a rotary encoder, or a combination of an optical sensor and a rotary encoder.

The output tray 50 stores multiple sheets M, on which images have been formed by the image former 30, in a stacked state. The output tray 50 is disposed downstream from the roller pair 27 in the conveyance direction and below the roller pair 27 and the leading-end guide 40. In other words, the output tray 50 is disposed at a position at which the sheet M, which is conveyed by the roller pair 27 and whose leading end is guided by the leading-end guide 40, falls freely.

Schematic Configuration of Lifting Mechanism 51

Figure 4:
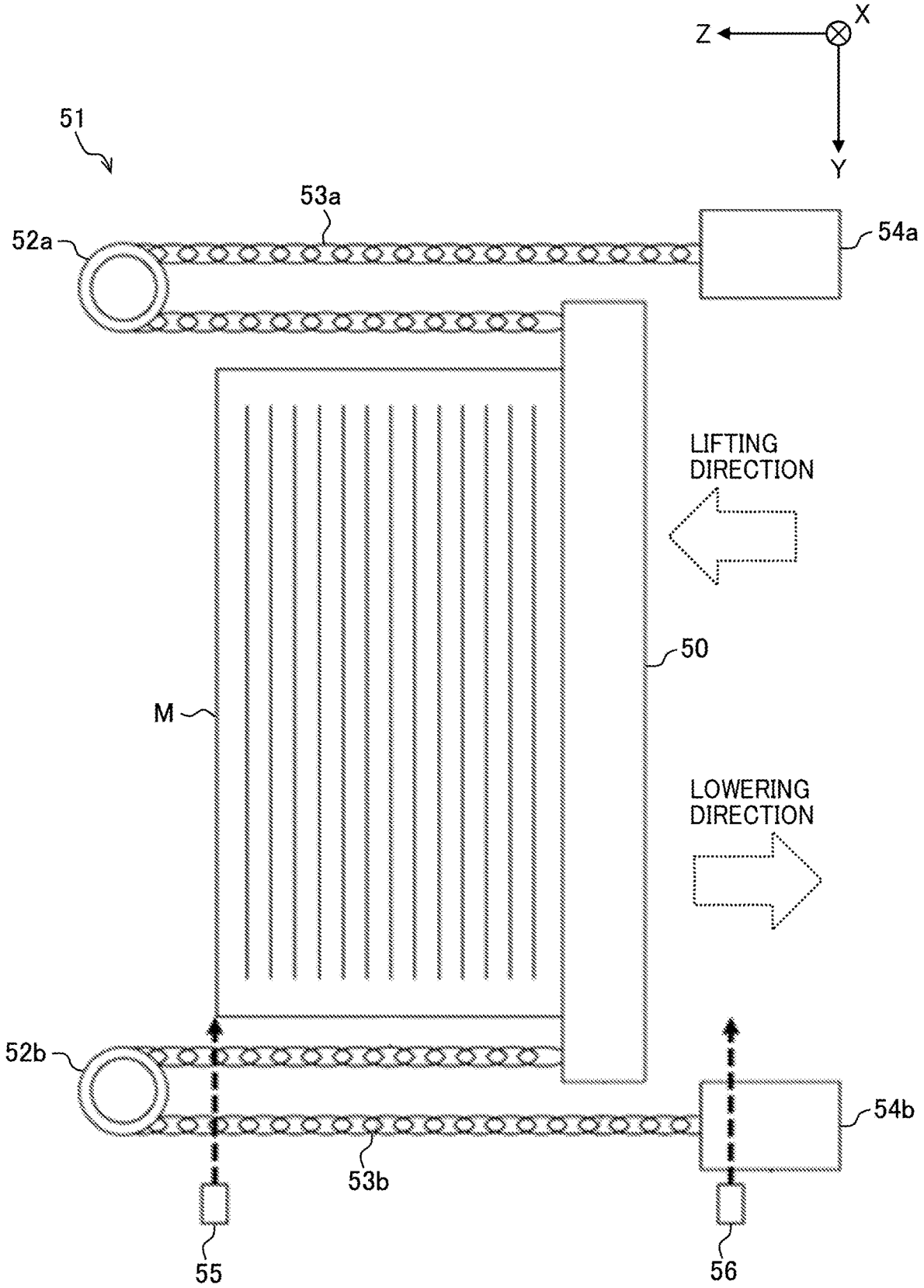
FIG. 4 is a diagram illustrating a schematic configuration of a lifting mechanism to lift or lower an output tray, according to an embodiment of the present disclosure.

FIG. 4 is a diagram illustrating a schematic configuration of a lifting mechanism 51 provided for the sheet stacker 3, to lift and lower the output tray 50, according to the present embodiment. As illustrated in FIG. 4, the output tray 50 that serves as a stacking table is movable in the up-and-down direction by the lifting mechanism 51. The lifting mechanism 51 typically includes a pair of pulleys 52*a* and 52*b*, a pair of chains 53*a* and 53*b*, a pair of weights 54*a* and 54*b*, an upper-limit sensor 55, and a lower-limit sensor 56. However, the specific structure of the lifting mechanism 51 is not limited to the example of FIG. 4.

The pair of pulleys 52*a* and 52*b* are rotatably supported by the housing of the printer 1 at positions above the output tray 50 and spaced apart from each other in the conveyance direction. Each of the pair of chains 53*a* and 53*b* is wound around the corresponding one of the pulleys 52*a* and 52*b*. One end of each of the pair of chains 53*a* and 53*b* is connected to the output tray 50, and the other end of each of the pair of chains 53*a* and 53*b* is connected to the corresponding one of the weights 54*a* and 54*b*.

When the pair of pulleys 52*a* and 52*b* rotate in a first direction, in which the pulley 52*a* rotates clockwise and the pulley 52*b* rotates counterclockwise in FIG. 4, the output tray 50 moves upward and the weights 54*a* and 54*b* move downward. On the other hand, when the pair of pulleys 52*a* and 52*b* rotate in a second direction opposite to the first direction, for example, the pulleys 52*a* and 52*b* rotate counterclockwise and clockwise, respectively, in FIG. 4, the output tray 50 is lowered and the weights 54*a* and 54*b* are lifted.

The upper-limit sensor 55 detects whether the position of an uppermost sheet M stacked on the output tray 50 reaches an upper-limit position that is a limit position up to which the sheet M is allowed to be lifted in the lifting mechanism 51. The upper-limit sensor 55 is disposed above the output tray 50. The upper-limit sensor 55 is, for example, a reflective optical sensor and includes a light emitter 55*a* that outputs light and a light receiver 55*b* that receives the light output from the light emitter 55*a* and reflected by the sheet M.

The upper-limit sensor 55 outputs a detection signal to a controller 100 (see FIG. 7) to be described later when a sheet M is present on an optical path, in other words, when the uppermost sheet M stacked on the output tray 50 has reached the upper-limit position. On the other hand, when no sheet M is present on the optical path, the upper-limit sensor 55 stops outputting the detection signal. However, the upper-limit sensor 55 is not limited to a reflective optical sensor and may be a transmissive optical sensor. When the controller 100 acquires a detection signal indicating that a sheet M has reached the upper-limit position, i.e., when the sheet M is present on the optical path, the controller 100 immediately stops lifting the output tray 50 regardless of a button operation or an operation mode to be described later.

The lower-limit sensor 56 detects that a maximum amount of sheets M is stacked on the output tray 50, and detects whether the output tray 50 has reached a lower-limit position that is a limit position up to which lowering of the output tray 50 is allowed. The lower-limit sensor 56 is disposed, for example, at a position facing the weight 54*b* when the output tray 50 is full. The lower-limit sensor 56 is, for example, a reflective optical sensor including a light emitter 56*a* that outputs light and a light receiver 56*b* that receives the light output from the light emitter 56*a* and reflected by the weight 54*b*.

The lower-limit sensor 56 outputs a detection signal to the controller 100 when the weight 54*b* is present on the optical path, in other words, when the output tray 50 is full and has reached the lower-limit position. On the other hand, when no weight 54*b* is present on the optical path, the lower-limit sensor 56 stops outputting the detection signal. However, the lower-limit sensor 56 is not limited to a reflective optical sensor and may be a transmissive optical sensor. When the controller 100 acquires a detection signal indicating that the output tray 50 has reached the lower-limit position, i.e., when a sheet M is present on the optical path, the controller 100 immediately stops lowering the output tray 50 regardless of a button operation or an operation mode to be described later.

Embodiment of Sheet Stacker 3

Figure 5:
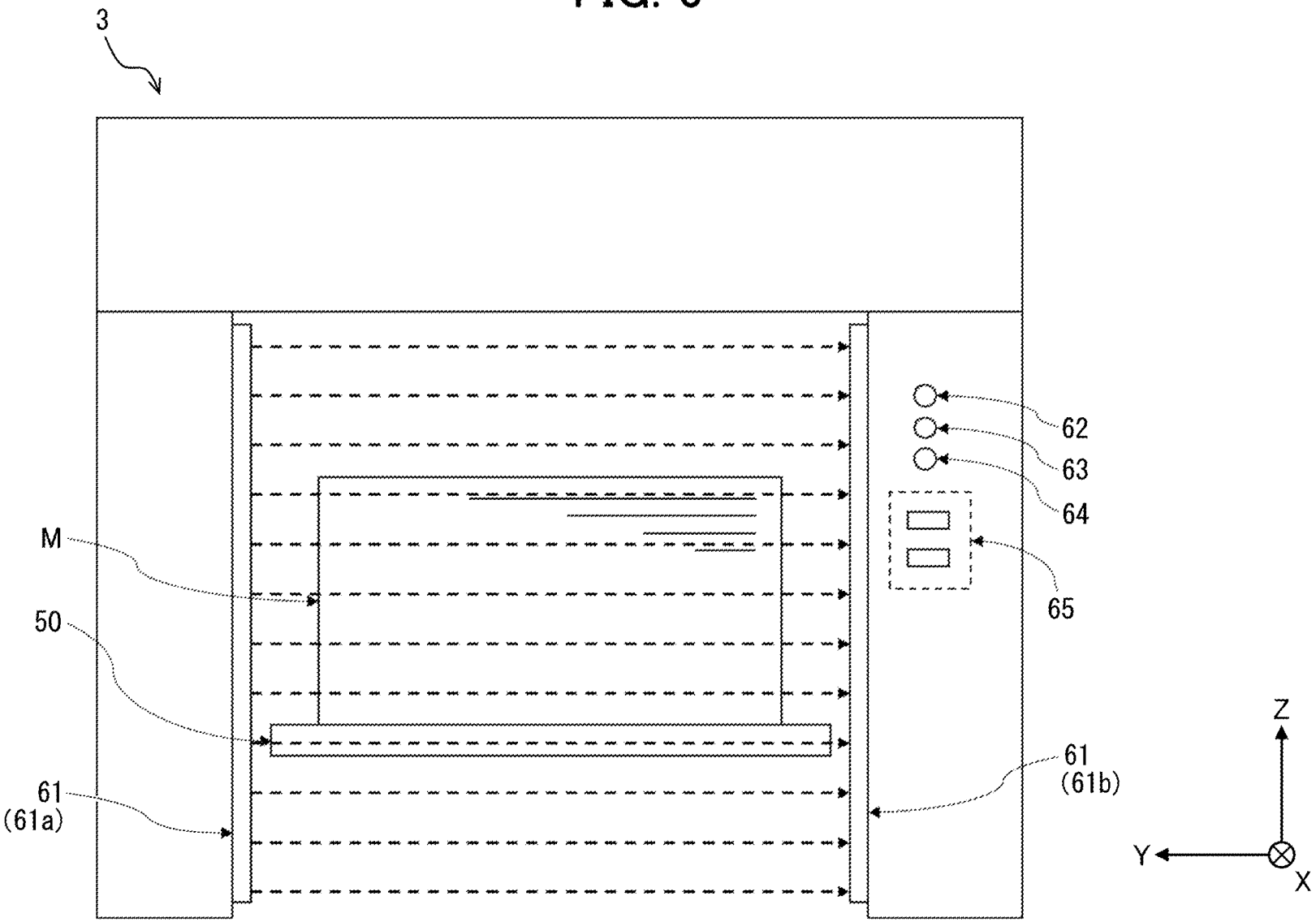
FIG. 5 is a front view of the sheet stacker of FIG. 3 including the lifting mechanism of FIG. 4.
Figure 6:
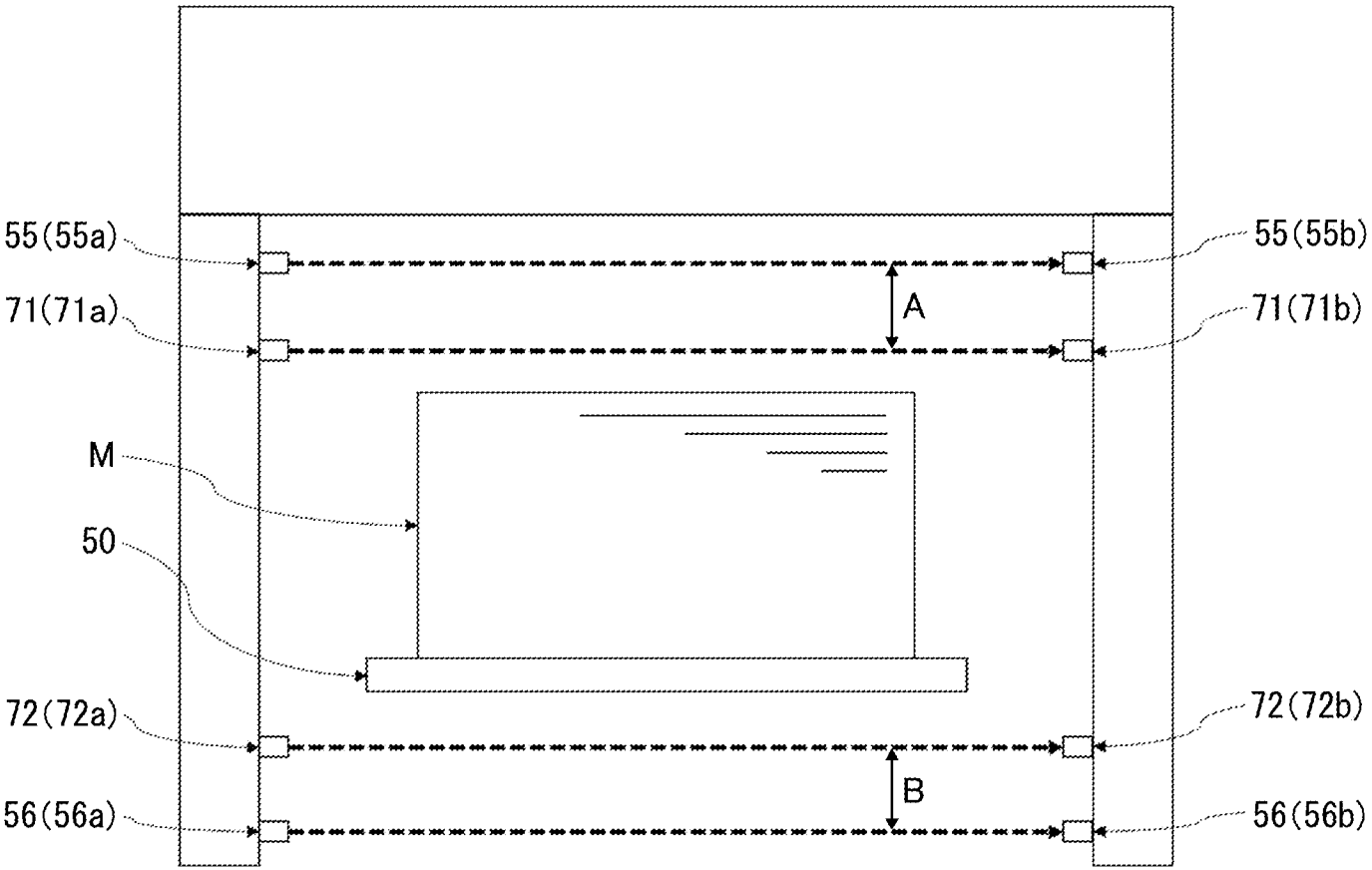
FIG. 6 is a diagram illustrating an internal configuration of the sheet stacker of FIG. 3 as viewed from the front side of the sheet stacker.

Next, the sheet stacker 3 according to an embodiment of the present disclosure is described in detail. FIG. 5 is a front view of the sheet stacker 3 according to the present embodiment. FIG. 6 is a diagram illustrating an internal configuration of the sheet stacker 3.

A lifting or lowering operation of the output tray 50 performed by the lifting mechanism 51 is performed by operating multiple operation buttons arranged on a front wall surface of the housing of the sheet stacker 3. The operation buttons as a lift operation device includes an up button 62, a stop button 63, and a down button 64. The up button 62, the stop button 63, and the down button 64 are disposed and arranged at positions that are easy for the operator to operate. For example, as illustrated in FIG. 5, the up button 62, the stop button 63, and the down button 64 are disposed on a front wall surface of the sheet stacker 3 in the vicinity of a space in which the output tray 50 is lifted and lowered.

The up button 62 is a button to be operated, i.e., pressed, when the output tray 50 is lifted by the operator. When the up button 62 is operated, a lift instruction is notified to the controller 100. When the controller 100 receives the lift instruction, the controller 100 rotates the pair of pulleys 52*a* and 52*b* in the first direction to lift the output tray 50. While the sheet stacker 3 operates in an automatic lifting and lowering mode, once the up button 62 is pressed, the sheet stacker 3 is lifted until the height of an uppermost sheet M reaches a position at which a lift pause sensor 71, to be described later, is installed even if pressing of the up button 62 is stopped.

The stop button 63 is a button to be operated, i.e., pressed when the operator stops lifting or lowering the output tray 50 by after the operator has performed an operation of lifting or lowering the output tray 50 in the automatic lifting and lowering mode. When the stop button 63 is operated, a stop instruction to cancel an operation instruction which has been previously performed is notified to the controller 100. When the controller 100 receives the stop instruction, the controller 100 stops the rotation of the pulleys 52*a* and 52*b*.

The down button 64 is operated, i.e., pressed to lower the output tray 50 by the operator. When the down button 64 is operated, an instruction to lower the output tray 50 is notified to the controller 100. When the controller 100 receives the instruction to lower the output tray 50, the controller 100 rotates the pair of pulleys 52*a* and 52*b* in the second direction to lower the output tray 50. While the sheet stacker 3 is in the automatic lifting and lowering mode, once the down button 64 is operated, the sheet stacker 3 is lowered until the height of the output tray 50 reaches a position at which a lowering pause sensor 72, to be described later, is installed even if the operation is stopped.

The front wall surface of the sheet stacker 3 also includes a lift control mode switching button 65 as a mode selector for an operator to selectively switch multiple lift control modes included in the sheet stacker 3.

The lift control mode switching button 65 has a light emitting function for providing a light emitting mode corresponding to a selected lift control mode. For example, the lift control mode switching button 65 includes two buttons and each of the buttons includes a light emitting diode (LED). The lift control mode switching button 65 turns on a respective LED of a button corresponding to the selected lift control mode. Thus, the operator can easily visually recognize the selected mode. Note that the lift control modes that are selectable include a manual lifting and lowering mode as a first control mode and an automatic lift control mode as a second control mode.

In addition, the sheet stacker 3 includes multiple entry sensors 61*a* and 61*b*, which may be collectively referred to as an entry sensor(s) 61, for detecting undesirable entry of an object from an opening of a space in which the output tray 50 is lifted and lowered as an access path to the output tray 50 on which sheets M are stacked. Each of the entry sensors 61 includes a pair of a light emitting element and a light receiving element. The entry sensors 61 are installed such that the entry sensors 61 can detect an entire opening of a stacking space in which sheets M are stacked. Each of broken-line arrows in FIG. 5 schematically indicates a light beam traveling from the light emitting element to the light receiving element of the entry sensor 61. When any one of the light beams is blocked and cannot be received by the light receiving element, an undesirable entry into the stacking space is detected. When the entry sensor 61 detects an undesirable object, the controller 100 stops the operation of the output tray 50.

FIG. 6 is a diagram illustrating an internal configuration of the sheet stacker 3 as viewed from the front side of the sheet stacker 3, according to the present embodiment. As illustrated in FIG. 6, the upper-limit sensor 55 and the lower-limit sensor 56 are disposed in the stacking space of the sheet stacker 3 as a space in which the output tray 50 is lifted or lowered as a stacking table. Further, a lift pause sensor 71 is disposed to detect the height of the stacked sheets M in order to temporarily stop lifting of the output tray 50 before the height of the uppermost sheet M is detected by the upper-limit sensor 55. Further, a lowering pause sensor 72 is disposed to detect the height of the output tray 50 in order to temporarily stop lowering of the output tray 50 before the height of the uppermost sheet M on the output tray 50 is detected by the lower-limit sensor 56.

The lift pause sensor 71 includes a pair of a light emitter 71*a* and a light receiver 71*b* and the lowering pause sensor 72 includes a pair of a light emitter 72*a* and a light receiver 72*b*, in a similar manner to the entry sensor 61. Accordingly, when the light emitted from the light emitters 71*a* and 72*a* of the lift pause sensor 71 and the lowering pause sensor 72 is blocked by sheets M or the output tray 50, an output signal from the lift pause sensor 71 or the lowering pause sensor 72 is changed to notify that the light is blocked. The controller 100 temporarily stops the lifting or lowering operation of the output tray 50 when the light receivers 71*b* and 72*b* of the lift pause sensor 71 and the lowering pause sensor 72, respectively, do not receive the light emitted from the light emitters 71*a* and 72*a* of the lift pause sensor 71 and the lowering pause sensor 72.

The lift pause sensor 71 is installed at a position that corresponds to a lift pause position to be described below, is lower than the position at which the upper-limit sensor 55 is disposed as the lift limit position, and is lower than the upper-limit sensor 55 by an allowable lift amount A.

The lift pause sensor 71 does not detect the height of the output tray 50 but detects the position of an uppermost sheet M of sheets M stacked on the output tray 50. Accordingly, the lift pause position, which is the position at which the lift pause sensor 71 is disposed, is a limit point or a limit position up to which automatic lifting of the output tray 50 is allowed. However, the lift pause position does not indicate the position of the output tray 50 itself.

In other words, the lift pause position is a position that indicates a boundary at which lifting of the output tray 50 on which the sheets M are stacked needs to be temporarily stopped and further lifting of the output tray 50 above the lift pause position is highly likely to cause the output tray 50 to collide with other components. For this reason, a region above the lift pause position is distinguished as a region within which automatic lifting of the output tray 50 is undesirable. On the other hand, a region below and up to the lift pause position is considered to be a region in which the output tray 50 can be safely lifted. Accordingly, the region below and up to the lift pause position is set in advance as an intermediate lift range.

The position at which the lowering pause sensor 72 is disposed corresponds to a lowering pause position and is higher than the position at which the lower-limit sensor 56 is disposed as the lower-limit position, and is higher than the lower-limit sensor 56 by an allowable lowering amount B.

Unlike the lift pause sensor 71, the lowering pause sensor 72 detects the height of the output tray 50. The lowering pause sensor 72 detects the height of the output tray 50 on condition that there is no component that may increase the height of the sheet stacker 3 below the output tray 50 and may obstruct downward movement of the output tray 50. In other words, the lowering pause position which is the position at which the lowering pause sensor 72 is disposed is a limit point or a limit position at which the automatic lowering of the output tray 50 is allowed. In other words, the lowering pause position indicates a boundary at which the lowering of the output tray 50 on which the sheets M are stacked needs to be temporarily stopped. Lowering the output tray 50 to a position equal to or lower than the lowering pause position is highly likely to cause the output tray 50 to collide with other components. For this reason, a region below the lift pause position is distinguished as a region within which automatic lowering of the output tray 50 is undesirable. On the other hand, the region above and up to the lowering pause position is considered to be a region in which the output tray 50 can be safely lowered. Accordingly, a region above and up to the lowering pause position is set in advance as the intermediate lift range.

Each of the lift pause sensor 71 and the lowering pause sensor 72 can be installed at any height position. For example, brackets may be disposed and installed in holes elongated in the height direction to hold the lift pause sensor 71 and the lowering pause sensor 72. Thus, the height position of the lift pause sensor 71 and the lowering pause sensor 72 can be adjusted. Accordingly, the allowable lift amount A that corresponds to a lift monitoring range and the allowable lowering amount B that corresponds to a lowering monitoring range can be set as desired.

The up button 62 or the down button 64 are operated to perform lifting or lowering operation of the output tray 50 automatically or manually in a height space between the lift pause sensor 71 and the lowering pause sensor 72, in other words, in the intermediate lift range which is an automatic lifting and lowering range. When the automatic lifting and lowering mode is selected, for example, even if the up button 62 is pressed once and released, the output tray 50 is automatically lifted until the output tray 50 has reached the lift-limit position. Similarly, even if the down button 64 is once pressed and released, the output tray 50 is automatically lowered until the output tray 50 has reached the lower-limit position. Note that when the stop button 63 is pressed while the output tray 50 is automatically lifted or lowered in the intermediate lift range, the lifting or lowering operation of the output tray 50 is stopped.

On the other hand, when the manual lifting and lowering mode is selected, for example, the output tray 50 is lifted while the up button 62 is pressed, and when the up button 62 is released, the output tray 50 automatically stops even if the output tray 50 has not reached the lift-limit position. Similarly, the output tray 50 is lowered while the down button 64 is pressed. When the down button 64 is released, the output tray 50 is automatically stopped even if the output tray 50 has not reached the lower-limit position. In addition, regardless of whether the output tray 50 is lifted or lowered in the automatic lifting and lowering mode or in the manual lifting and lowering mode, the lifting or lowering operation of the output tray 50 is always stopped when the lift pause sensor 71 or the lowering pause sensor 72 detects that the output tray 50 has reached the limit position.

When the lift pause sensor 71 detects that the output tray 50 has reached the limit position and the lifting or lowering operation of the output tray 50 is temporarily stopped, the output tray 50 goes to a standby mode. When it is desired to further lift the output tray 50 after the output tray 50 goes to the standby mode, the output tray 50 is lifted only while the operator continues to press the up button 62 even if the automatic lifting and lowering mode is selected. Similarly, when the lowering pause sensor 72 detects that the output tray 50 has reached the limit position and the lifting or lowering operation of the output tray 50 is temporarily stopped, the output tray 50 goes to the standby mode. When it is desired to further lower the output tray 50 after the output tray 50 goes to the standby mode, the output tray 50 is lowered only while the operator continues to press the down button 64 even if the automatic lifting and lowering mode is selected.

Such a configuration as described above allows a lifting or lowering mode of the output tray 50 to be changed in a specified range. Accordingly, a range in which a component may be damaged when the lifting or lowering operation is automatically performed is set by the allowable lift amount A and the allowable lowering amount B. Accordingly, a range in which a manual operation is desirable from the viewpoint of preventing damage to the sheet stacker 3 can be specified and the lifting or lowering operation of the output tray 50 can be properly controlled, while the convenience of the operator in the lifting or lowering operation of the output tray 50 is maintained.

Embodiments of Control Configuration

Figure 7:
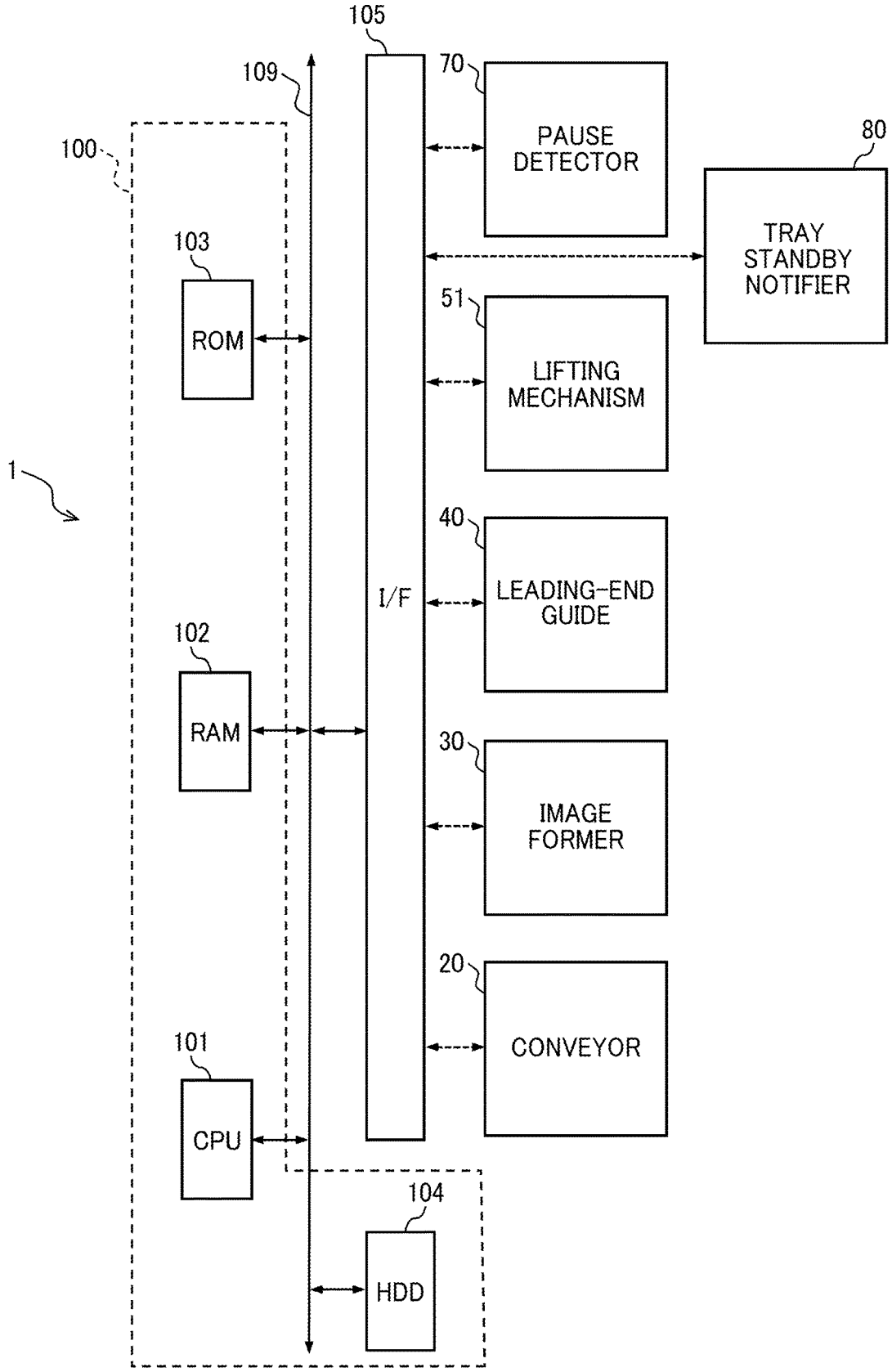
FIG. 7 is a diagram illustrating a hardware configuration of the image forming apparatus of FIG. 1, including the lifting mechanism of FIG. 4, according to an embodiment of the present disclosure.

Next, a control configuration of the printer 1 according to an embodiment of the present disclosure is described with reference to FIG. 7. FIG. 7 is a diagram illustrating a hardware configuration of the printer 1 that includes the lifting mechanism 51, according to the present embodiment. The printer 1 includes a central processing unit (CPU) 101 as a control device, a random access memory (RAM) 102 as a storage device, a read only memory (ROM) 103 as a storage device, a hard disk drive (HDD) 104 as a storage device, and an interface (I/F) 105. The CPU 101, the RAM 102, the ROM 103, the HDD 104, and the I/F 105 are connected to each other via a common bus 109 as a communication member. The controller 100 includes, for example, the CPU 101, the RAM 102, the ROM 103, and the HDD 104.

The controller 100 controls the operations of the entire printer 1, including the operations of the image forming device 2 and the sheet stacker 3.

The CPU 101 is an arithmetic unit that executes arithmetic processing defined by a predetermined control program for controlling the overall operation of the printer 1. The RAM 102 is a volatile storage medium capable of reading and writing data at high speed and is employed as a work area when the CPU 101 processes the data. The ROM 103 is a read-only non-volatile storage medium in which programs such as firmware are stored. The HDD 104 is a large-capacity non-volatile storage medium capable of reading and writing data and stores, for example, an operating system (OS), various control programs, and application programs.

The printer 1 processes control programs stored in the ROM 103, and a data processing program, which is an application program, loaded into the HDD 104 from a storage media such as the RAM 102, by a calculation function included in the CPU 101. Such processing as described above is performed by a software controller that includes various functional modules of the printer 1. A functional block that implements the functions of the printer 1 includes a combination of the software controller as described above and the hardware resources installed in the printer 1.

The I/F 105 is an interface that connects the conveyor 20, the image former 30, the leading-end guide 40, the lifting mechanism 51, and the pause detector 70 to the common bus 109. In other words, the controller 100 controls the operations of the conveyor 20, the image former 30, the leading-end guide 40, the lifting mechanism 51, the pause detector 70, and a tray standby notifier 80 as a notifier via the I/F 105.

The pause detector 70 acquires signals output from the lift pause sensor 71 and the lowering pause sensor 72. Based on a change in the output signal acquired by the pause detector 70, the controller 100 determines whether the output tray 50 has reached the upper-limit position or whether the output tray 50 has reached the lower-limit position. When the controller 100 determines that the output tray 50 has reached the lift-limit position or the lower-limit position, the lifting or lowering operation of the output tray 50 is stopped regardless of the content of the operation input.

The pause detector 70 also acquires output signals of the multiple entry sensors 61. When the controller 100 detects an undesirable entry into the stacking space based on the output signal of the entry sensor 61, the controller 100 also stops the lifting or lowering operation of the output tray 50.

Lifting and Lowering Control Processing

Figure 8:
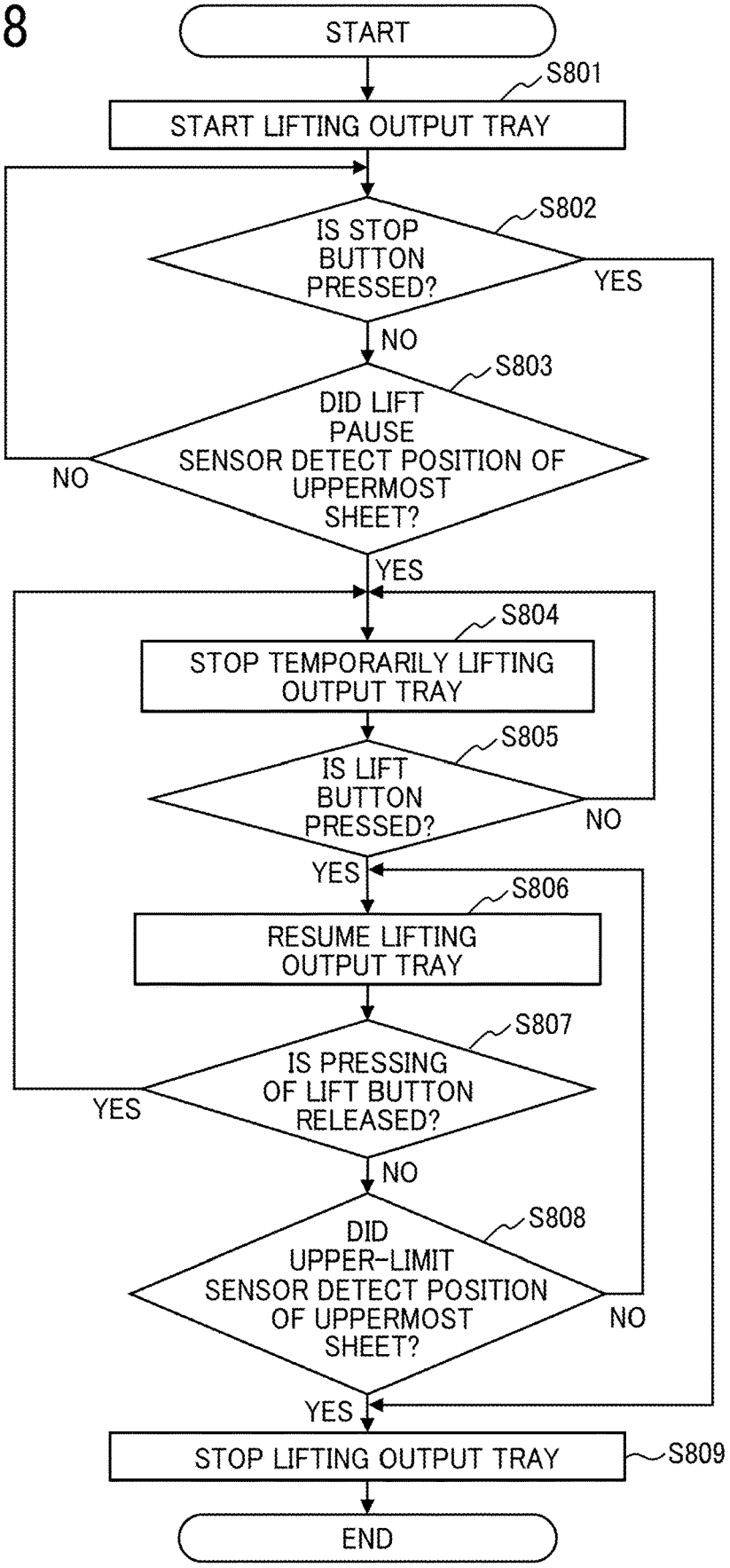
FIG. 8 is a flowchart illustrating a procedure of controlling lifting of the output tray, according to an embodiment of the present disclosure.
Figure 9:
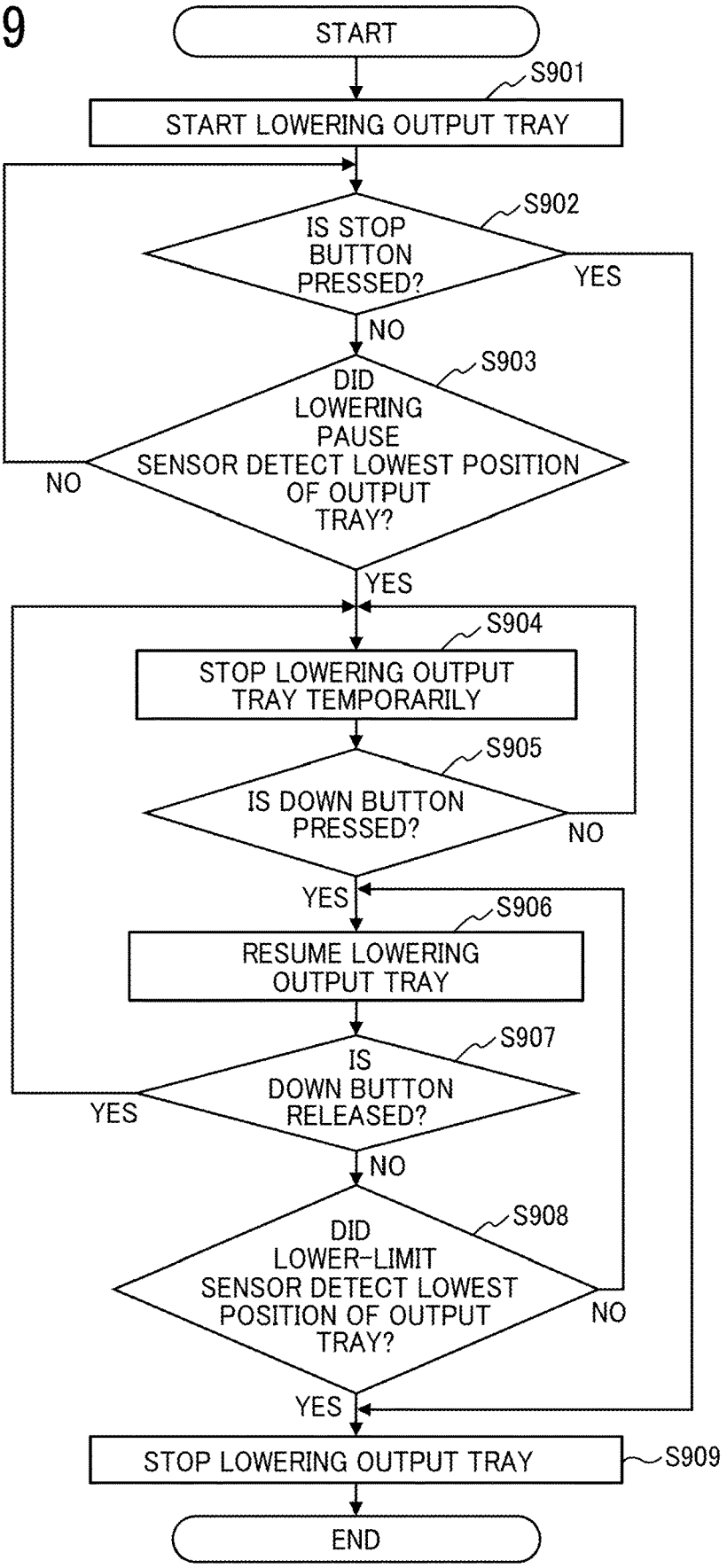
FIG. 9 is a flowchart illustrating a procedure of controlling lowering of the output tray of FIG. 4, according to an embodiment of the present disclosure.

Next, a flow of lifting and lowering control processing executed in the sheet stacker 3 according to the present embodiment is described with reference to a flowchart of FIG. 8. FIG. 8 is a flowchart illustrating a procedure of controlling lifting of the output tray 50, according to the present embodiment. FIG. 9 is a flowchart illustrating a procedure of controlling lowering of the output tray 50, according to the present embodiment. The lifting or lowering operation described below illustrates a case in which the lifting and lowering mode is the automatic lifting and lowering mode.

Lifting Control Processing

When the output tray 50 is lifted, the operator first presses the up button 62. Accordingly, when the controller 100 detects that the up button 62 is pressed, the controller 100 starts a lifting operation of the output tray 50 (step S801). When the controller 100 detects that the stop button 63 is pressed after the output tray 50 starts to be lifted (YES in step S802), the controller 100 stops lifting the output tray 50 (step S809). When pressing of the stop button 63 is not detected (NO in step S802), the controller 100 continues lifting the output tray 50 until the lift pause sensor 71 detects the position of an uppermost sheet M (NO in step S803).

When the lift pause sensor 71 detects the position of the uppermost sheet M (YES in step S803), the output tray 50 has reached the upper limit of the intermediate lift range. Thus, the controller 100 temporarily stops lifting the output tray 50 (step S804). Then, the controller 100 maintains a state in which the output tray 50 is stopped until the pressing of the up button 62 is detected again (NO in step S805). When the output tray 50 is temporarily stopped in step S804, the controller 100 selectively controls one or multiple operations, such as emitting a predetermined sound via the tray standby notifier 80, blinking the up button 62, and performing a combination of the above-described operations, to execute a predetermined notification operation. Accordingly, a notification that prompts the operator to perform a subsequent operation can be issued.

When the controller 100 detects that the up button 62 is pressed again (YES in step S805), the controller 100 resumes lifting the output tray 50 (step S806). Then, the controller 100 continues lifting the output tray 50 until the pressing of the up button 62 is released, in other words, while the pressing of the up button 62 is continued (NO in step S807) and until the upper-limit sensor 55 detects the position of the uppermost sheet M (NO in step S808).

After the up button 62 has been pressed again (YES in step S805) and lifting of the output tray 50 is resumed (step S806), when the pressing of the up button 62 is released (YES in step S807), the controller 100 temporarily stops lifting the output tray 50 (step S804). In this case, the lifting operation of the output tray 50 continues to be stopped until the up button 62 is pressed again (NO in step S805).

In other words, when the output tray 50 has reached the lift monitoring range, the output tray 50 is always temporarily stopped, and the subsequent lift operation is performed only while the operator operates, i.e., presses the up button 62. Accordingly, in the automatic lifting and lowering mode, the operator operates, i.e., presses the up button 62 once. By so doing, the operator does not need to operate the up button 62 to lift the output tray 50 in the intermediate lift range. On the other hand, lifting of the output tray 50 in the lift monitoring range is performed only while the up button 62 is pressed. When the stop button 63 is operated, i.e., pressed or pressing of the up button 62 is released, the lifting of the output tray 50 is stopped.

According to the above-described control, operating the up button 62 once allows the output tray 50 to be automatically lifted in the intermediate lift range. When the output tray 50 has reached the lift monitoring range, the lifting of the output tray 50 is temporarily stopped without fail, and the output tray 50 can be lifted only while the operator operates the output tray 50. Thus, a range in which the manual operation is desirable from the viewpoint of preventing damage to the sheet stacker 3 can be specified and the lifting or lowering of the output tray 50 can be properly controlled, while the convenience of the operator in the lifting operation of the output tray 50 is maintained.

Lowering Control Processing

When the output tray 50 is lowered, the operator first presses the down button 64. When it is detected that the down button 64 is pressed, the lowering operation of the output tray 50 is started (step S901). When the stop button 63 is pressed after the lowering operation of the output tray 50 is started (YES in step S902), the lowering operation of the output tray 50 is stopped (step S909). If the stop button 63 is not pressed (NO in step S902), the output tray 50 continues to be lowered until the lowering pause sensor 72 detects a lowest position of the output tray 50 (NO in step S903).

When the lowering pause sensor 72 detects the lowest position of the output tray 50 (YES in step S903), the output tray 50 has reached the lower limit of the intermediate lift range. Thus, the controller 100 temporarily stops lowering the output tray 50 (step S904). Then, the controller 100 maintains a state in which the output tray 50 is stopped until the pressing of the down button 64 is detected again (NO in step S905). When the output tray 50 is temporarily stopped in step S904, the controller 100 selectively controls one or multiple operations, out of emitting a predetermined sound via the tray standby notifier 80, blinking the down button 64, and performing a combination of the above-described operations, to execute a predetermined notification operation. Accordingly, a notification that prompts the operator to perform a subsequent operation can be issued.

When the controller 100 detects that the down button 64 is pressed (YES in step S905), the controller 100 resumes lowering the output tray 50 (step S906). Then, the controller 100 continues to lower the output tray 50 until pressing of the down button 64 is released (NO in step S906) and the lower-limit sensor 56 detects the lowest position of the output tray 50 (NO in step S908).

After the down button 64 has been pressed again (YES in step S905) and lowering of the output tray 50 is resumed (step S906) and when the pressing of the down button 64 is released (YES in step S907), the controller 100 temporarily stops lowering the output tray 50 (step S904). In this case, the lowering operation of the output tray 50 continues to be stopped until the down button 64 is pressed again (NO in step 905).

In other words, when the output tray 50 has reached the lowering monitoring range, the output tray 50 is always temporarily stopped, and the subsequent lowering operation is performed only while the operator operates, i.e., presses the down button 64. Accordingly, in the automatic lifting and lowering mode, the operator does not need to operate, i.e., press the down button 64. On the other hand, the lowering operation of the output tray 50 in the lowering monitoring range is performed only while the down button 64 is pressed. When the stop button 63 is operated, i.e., pressed or pressing of the down button 64 is released, the lowering operation of the output tray 50 is stopped.

According to the above-described control, operating the down button 64 once allows the output tray 50 to be automatically lowered. When the output tray 50 approaches the lower limit, the output tray 50 is temporarily stopped and then can be lowered by the operation of the operator. Accordingly, a range in which the manual operation is desirable from the viewpoint of preventing damage to the sheet stacker 3 can be specified. The lifting or lowering of the output tray 50 can be properly controlled while the convenience of the operator in the lowering operation of the output tray 50 is maintained.

Note that the present disclosure is not limited to specific embodiments described above, and numerous additional modifications and modifications are possible in light of the teachings within the technical scope of the appended claims. It is therefore to be understood that the disclosure of the present specification may be practiced otherwise by those skilled in the art than as specifically described herein. Such embodiments and modifications of the present disclosure are included in the scope and gist of the embodiments of the present disclosure and are included in the embodiments described in claims and the equivalent scope of the present disclosure.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A sheet stacker comprising:

a lifting mechanism;

a tray configured to stack a plurality of sheets;

a conveyor disposed above the tray to convey a sheet in a conveyance direction;

processing circuitry configured to control, via the lifting mechanism, a height position of the tray on which the plurality of sheets conveyed by the conveyor is stacked;

an upper-limit sensor configured to detect that an uppermost sheet of the plurality of sheets stacked on the tray has reached an upper-limit position;

a lift pause sensor configured to detect that the uppermost sheet of the plurality of sheets stacked on the tray has reached a lift pause position lower than the upper-limit position;

a lower-limit sensor configured to detect that the tray has reached a lower-limit position;

a lowering pause sensor configured to detect that the tray has reached a lowering pause position higher than the lower-limit position, the upper-limit sensor, the lift pause sensor, the lower-limit sensor, and the lowering pause sensor disposed in a space in which the tray is lifted and lowered; and a lift operation device configured to instruct the processing circuitry to lift and lower the tray, and issue an operation instruction to the processing circuitry in response to a predetermined operation, the operation instruction including an instruction to lift the tray and an instruction to lower the tray, wherein the processing circuitry is configured to:

cause the tray to be lifted or lowered in accordance with the operation instruction;

continue lifting or lowering the tray even if the operation instruction is not issued after the instruction to lift the tray or the instruction to lower the tray is once issued based on one operation of the lift operation device;

stop lifting or lowering the tray when the lift pause sensor or the lowering pause sensor detects that the tray has reached the lift pause position or the lowering pause position; and after stopping lifting or lowering the tray, cause the tray to be lifted beyond the lift pause position or lowered beyond the lowering pause position only while the operation instruction is issued.

2. The sheet stacker according to claim 1, wherein the lift pause position and the lowering pause position are adjustable in the space in which the tray is lifted and lowered.

3. The sheet stacker according to claim 1 , wherein the processing circuitry is configured to perform a manual operation in which lifting or lowering the tray is continued in accordance with the operation instruction while the instruction to lift the tray or the instruction to lower the tray is issued, and lifting or lowering the tray is stopped when the operation instruction is not issued.

4. The sheet stacker according to claim 1, wherein the processing circuitry is configured to stop lifting or lowering the tray when the processing circuitry receives an instruction to stop lifting or lowering the tray while the processing circuitry continues to cause the tray to be lifted or lowered in accordance with the operation instruction.

5. The sheet stacker according to claim 1, further comprising a notifier to notify that the tray has entered a standby mode, wherein the processing circuitry is configured to notify via the notifier that the tray has reached the lift pause position or the lowering pause position when the lift pause sensor or the lowering pause sensor detects that the tray has reached the lift pause position or the lowering pause position.

6. The sheet stacker according to claim 1, circuitry of another operation instruction for causing a first control mode and a second control mode to be selectable, wherein, in the first control mode, the processing circuitry is configured to:

continue lifting or lowering of the tray in response to the operation instruction while the instruction to lift the tray is issued; and stop lifting or lowering the tray when the operation instruction is not issued, wherein, in the second control mode, the processing circuitry is configured to:

continue lifting or lowering of the tray even if the operation instruction is not issued after the instruction to lift the tray or the instruction to lower the tray is once notified based on one operation of the lift operation device; and stop lifting or lowering of the tray when the lift pause sensor or the lowering pause sensor detects that the tray has reached the lift pause position or the lowering pause position.

7. The sheet stacker according to claim 6, wherein the mode selector has a light emitting function of setting a light emitting mode according to a selected control mode.

8. An image forming apparatus comprising:

an image former to form an image on a sheet; and the sheet stacker according to claim 1 to stack the sheet on which the image has been formed by the image former on the tray.

* * * * *